United States Patent [19]

Levy

[11] 3,995,150

[45] Nov. 30, 1976

[54] LAMP APPARATUS AND METHOD OF ASSEMBLY

[75] Inventor: George D. Levy, Wellesley Hills, Mass.

[73] Assignee: ACLA, Inc., Boston, Mass.

[22] Filed: Jan. 9, 1975

[21] Appl. No.: 539,647

[52] U.S. Cl. ..... 240/10 B; 240/153

[51] Int. Cl.[2] ..... F21V 19/00

[58] Field of Search ..... 240/10 R, 10 B, 10 D, 240/10.64, 153; 248/314, 27; 339/25, 206 L, 207 R, 209, 213 R

[56] References Cited

UNITED STATES PATENTS

| | | | |
|---|---|---|---|
| 1,594,138 | 7/1926 | Wisckhusen et al. | 240/10 B |
| 1,665,867 | 4/1928 | Wocktel | 240/10.64 |
| 1,831,443 | 11/1931 | Goldman | 240/10 B |
| 2,101,971 | 12/1937 | Wolf | 240/10 B |
| 2,389,455 | 11/1945 | Benander | 339/213 R |
| 2,712,059 | 6/1955 | Allyn | 240/10.64 X |
| 3 340,391 | 9/1967 | Heyden | 240/10.64 |
| 3,373,274 | 3/1968 | Kott | 240/10.64 |
| 3,576,990 | 5/1971 | Johnson et al. | 240/10 B |
| 3,760,177 | 9/1973 | Levy | 240/10 B |

FOREIGN PATENTS OR APPLICATIONS

| | | | |
|---|---|---|---|
| 2,115,064 | 10/1972 | Germany | 339/209 |

*Primary Examiner*—Joseph F. Peters, Jr.
*Attorney, Agent, or Firm*—Wolf, Greenfield & Sacks

[57] ABSTRACT

An electrified decorative candle array for use usually on holidays or other festive occasions employs low wattage midget lamps. These midget lamps are typically fabricated in a string with the lamps connected in parallel to each other and an adapter is provided for holding each lamp in the desired position at the top of a candle-shaped holder which is generally larger in diameter than the midget lamp and its associated holder or husk. In accordance with the method of assembly of this invention, a multiple candle holder jig is provided for holding the lamp string in position to be received by the candle array.

8 Claims, 18 Drawing Figures

LAMP APPARATUS AND METHOD OF ASSEMBLY

BACKGROUND OF THE INVENTION

The present invention relates, in general, to a lamp apparatus and pertains more particularly, to an electrified decorative candle array.

There are presently sold for use during the Christmas season, electrified candle apparatus or candelabras. One of these devices typically include eight 7 watt lamps and thus the total wattage of the device is 56 watts of electricity.

Due to the rising cost of electrical energy, there is a need for a decorative candle apparatus which consumes less energy without significantly decreasing the amount of illumination. Midget base lamps do provide adequate illumination at significantly decreased wattage, but due to the high labor cost of assembling these tiny sockets and lights, it has not been worthwhile especially in this country to use these midget lamps. Also, it has not been practical to assemble a complete electrified candle device in a foreign country where the labor rate is low because the completed device is bulky to ship and the freight costs are prohibitive.

Accordingly, one object of the present invention is to provide an improved electrified candle apparatus or candelabra using low wattage, preferably midget lamps.

Another object of the present invention is to provide an electrified decorative candle apparatus that consumes substantially less electricity than prior art apparatus.

A further object of the present invention is to provide an electrified candelabra that comprises a string of midget lamps which are readily assembled in a typical prior art candle holder array.

Still a further object of the present invention is to provide a simple method of assembling a string of lamps in a multiple candle holder. In this connection in accordance with the present invention, there is also provided a novel jig arrangement for practicing the method of this invention.

SUMMARY OF THE INVENTION

To accomplish the foregoing and other objects of this invention, there is provided a lamp apparatus which generally comprises at least one hollow candle tube, means for supporting the candle tube at one end to permit the tube to stand substantially vertically, a lamp assembly including a low voltage lamp, a receiving socket and conductor means carried by the receiving socket, and an adapter having means defining an opening for receiving the socket dimensioned for a snug fit within the top end of the candle tube. In the preferred embodiment, the apparatus is in the form of a candelabra having a plurality of candle tubes arranged in line. The typical electrified Christmas candelabra contains eight such candle tubes. The adapter permits attachment of a midget lamp to a conventional candelabra. The string of lamps themselves may be manufactured at low labor costs, for example in a foreign country, and shipped to this country in a compact form at relatively low freight costs.

In accordance with the method of this invention, the string or set of lamps is then threaded into the candelabra with each candle tube receiving a midget lamp with the further addition of the adapter of the present invention. In accordance with the method of the present invention, each lamp can be individually threaded up the candle tube and the adapter can then be inserted from the top over the lamp socket. The adapter and lamp are then fitted into the top of the candle tube. Alternatively, in accordance with more automated method of assembling the device of this invention, there is provided a jig with a shape similar to the shape of the candelabra with individual fixtures for receiving each of the lamps. The candelabra is then fitted over this jig, each of the adapters is fitted to the socket, the adapter and socket are inserted into the tube, and the entire candelabra is then removed from the jig.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
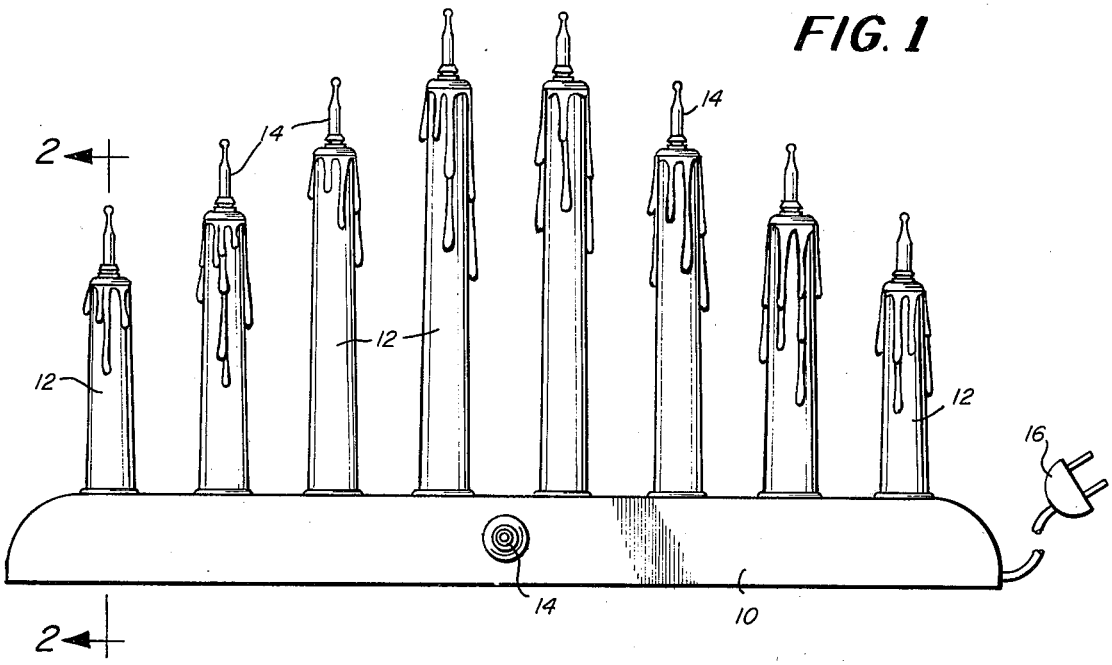
FIG. 1 shows the candelabra of the present invention using midget lamps.

FIG. 1 shows a candelabra or candle apparatus constructed in accordance with the present invention. This apparatus is generally constructed of plastic and comprises a base 10 and a plurality of candle tubes 12 which may have a simulated candle appearance and are suitably secured to the base 12 or formed integrally therewith. FIG. 1 also shows the midget lamps 14 which are secured at the top of each candle tube 12.

Figure 2:
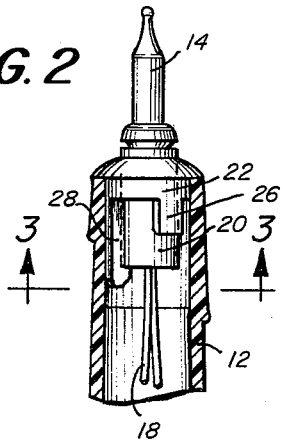
FIG. 2 is a partial cross-sectional view taken along line 2—2 of FIG. 1 and showing one embodiment for an adapter in accordance with this invention.

In accordance with the method of this invention, a string of these midget lamps 14 is provided. This string, of course, includes a plurality of conductor wires and a conventional AC plug 16 which is also shown in FIG. 1 extending from the base 10. FIG. 2 shows two of these conductor wires 18 extending from the socket 20 which holds one of the midget lamps 14. In accordance with the method each of the sockets and associated lamps are threaded up through the tube 12 and are permitted to extend above the top of the candle tube 12 so as to permit an adapter 22, as shown in FIG. 2, to be inserted over the socket 20. The adapter is then of a size to fit snugly within the top end of the tube 12.

Figure 3:
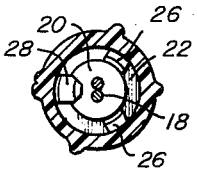
FIG. 3 is a cross-sectional view taken along line 3—3 of FIG. 2.
Figure 4:
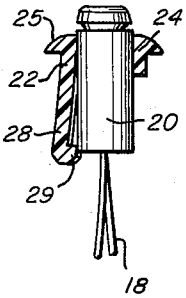
FIG. 4 is a partial cross-sectional view showing only the adapter and socket.

FIGS. 2–4 show one embodiment of the adapter 22 which comprises a top toroidal section 24 having a lip 25 that is pushed down against the top edge of the tube 12. The adapter 22 also includes two downwardly depending short legs 26 and a downwardly depending longer leg 28 having a flange 29 for fitting under the bottom of the socket 20. FIG. 2 shows the socket and adapter after the adapter has been forced downwardly into its final position. FIG. 4 shows the adapter 22 as it is just being moved downwardly relative to the socket with the flange 29 not yet engaging the bottom edge of the socket.

The midget lamp assemblies including the lamp 14 and the socket 20 typically are provided in a string of 10 and as there are only eight candle tubes, two additional midget lamps may be incorporated in the base 10 on either side. FIG. 1 shows one of these lamps in the base 10. The string of 10 lamps consumes approximately 14 watts and thus it can be seen that there is a drastic saving in energy over the use of the standard light array that employs the C7 ½ candle.

Figure 5:
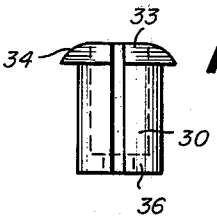
FIG. 5 is a front view of another embodiment for an adapter.
Figure 6:
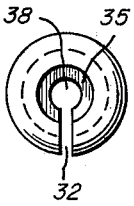
FIG. 6 is a top view of the adapter shown in FIG. 5.

FIGS. 5 and 6 show another adapter which is in the form of a cylinder 30 having a longitudinal slot 32 extending vertically down one side and including a top toroidal section 33 with an outwardly extending lip 34. The cylindrical form is hollow and the inside void 35 is constructed in size to receive the socket 20. The socket 20 is limited in its vertical downward movement by means of the bottom wall 36 which also defines a wire accommodating hollow 38.

Figure 7:
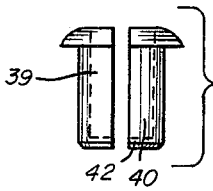
FIG. 7 shows a front view of still another embodiment of the adapter.
Figure 9:
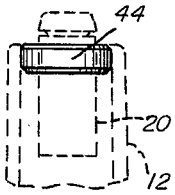
FIG. 9 shows still a further embodiment for an adapter.
Figure 8:
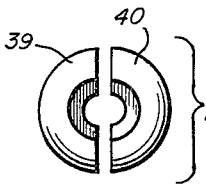
FIG. 8 is a top view of the adapter shown in FIG. 7.
Figure 10:
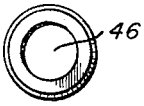
FIG. 10 is a top view of the adapter shown in FIG. 9.

Still another embodiment is shown in FIGS. 7 and 8. This embodiment is substantially identical to the one shown in FIGS. 5 and 6 but instead of providing a single slot the adapter is constructed in two sections 39 and 40. This adapter also comprises a top toroidal section, is hollow, and has a bottom wire accommodating passage in the bottom limiting wall 42.

With the adapters shown in FIGS. 5–8 the lamp assembly is pulled sufficiently upwardly out of the candle tube so as to permit the wires 18 to fit in the slot 32, for example, regarding the embodiments shown in FIGS. 5 and 6. Then the adapter or bushing and socket are pushed back into the tube into the position like that shown in FIG. 2. As previously mentioned, the walls 36 and 42 prevent the socket from slipping down inside the tube 12.

In order to secure the socket 20 within the tube 12, there can also be provided a washer 44 which has an inside hole 46 small enough to press-fit over the socket 20 after the socket has been threaded through the candle tube 12. The socket may then be lowered into the candle tube and the washer 44 may be glued, for example, to the top of the tube 12. The washer 44 could also be designed to have an outside diameter that would press-fit back into the tube 12.

Figure 11:
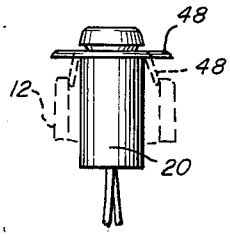
FIG. 11 is a further embodiment for an adapter wherein the adapter is attached directly to the socket.
Figure 12:
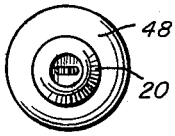
FIG. 12 is a top view of the arrangement shown in FIG. 11.

FIGS. 11 and 12 show another embodiment wherein the adapter may be integrally formed with the socket 20 and is in the form of an annular wafer thin lip flange 48 which is flexible enough to permit the socket to be threaded up through the candle tube. In FIG. 11, the lip 48 is shown also in dotted indicating that this lip easily deflects when the socket 20 is pushed up through the candle tube 12. To secure the socket and lip 48 in place, the lip may be glued to the top edge of the tube 12.

Figure 13:
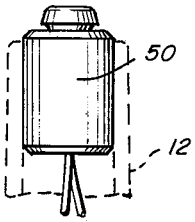
FIG. 13 shows an alternate socket arrangement.
Figure 14:
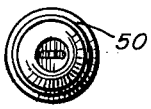
FIG. 14 is a top view of the arrangement shown in FIG. 13.

FIGS. 13 and 14 show a special socket 50 which is much larger than the socket 20 shown in the other figures. This socket 50 is for accommodating the midget lamp but is made especially larger in diameter so as to snugly fit within the candle tube 12. With the arrangements shown in FIGS. 13 and 14 the socket is fed up through the tube and may be held in place either totally by friction or by being glued in place.

Figure 15:
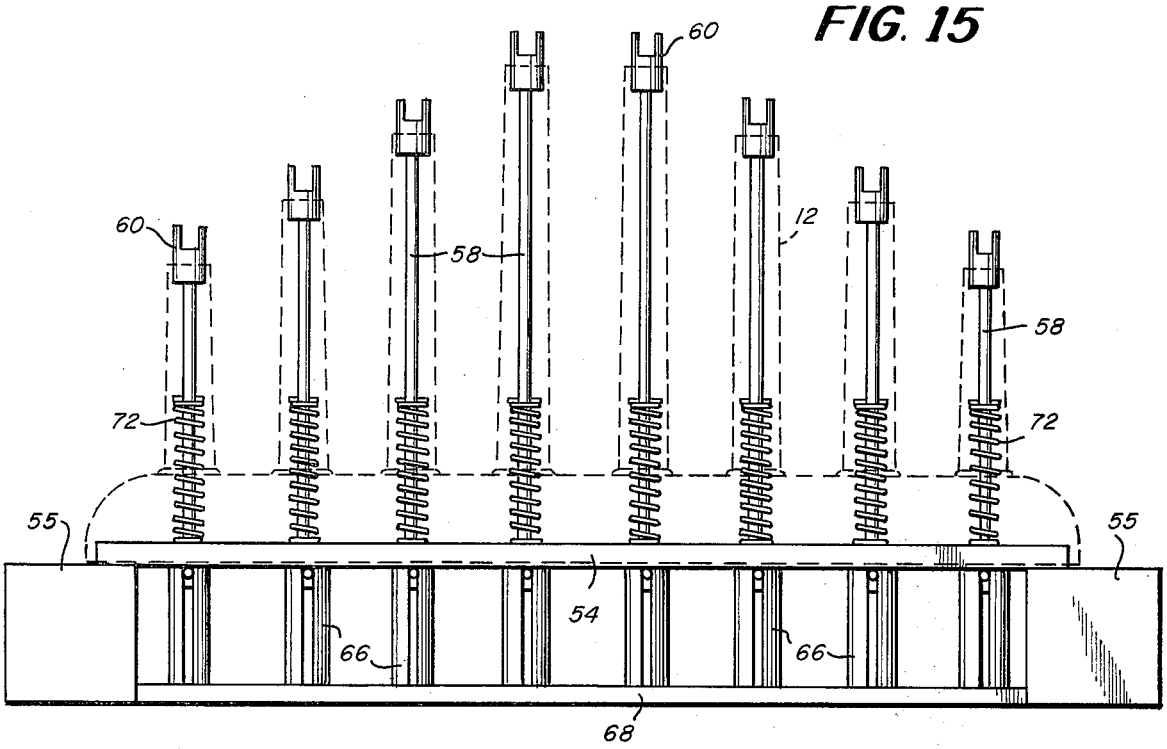
FIG. 15 shows a jig of the present invention used in practicing the method of this invention.
Figure 16:
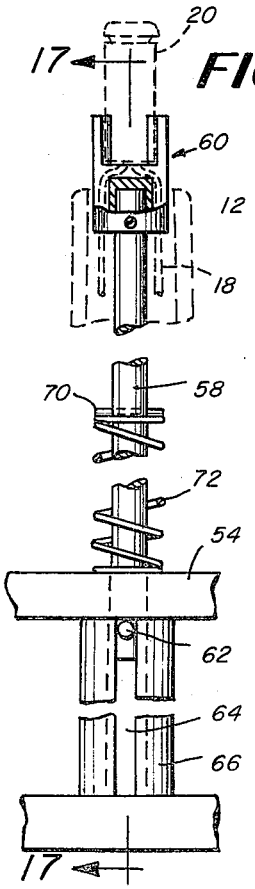
FIG. 16 is a slightly enlarged view of one of the lamp holder showing the socket and associated wires in dotted.
Figure 17:
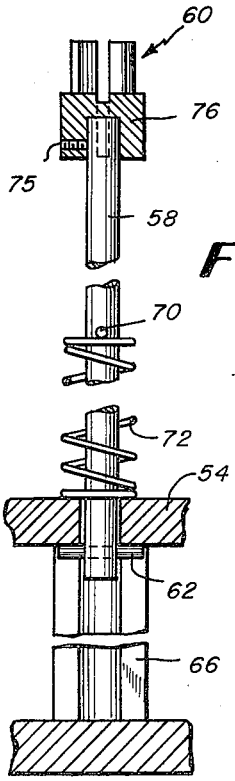
FIG. 17 is a similar view to that shown in FIG. 16 taken along line 17—17 of FIG. 16.
Figure 18:
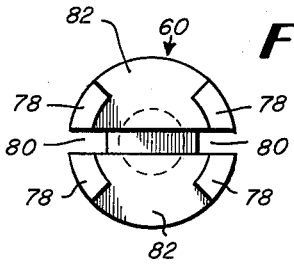
FIG. 18 is an enlarged top view of FIGS. 16 or 17.

FIG. 15 shows a jig for use in practicing a semi-automatic version of the method of this invention. The jig comprises a platform 54 supported at either end by blocks 55 and a plurality of reciprocating rods 58 each of which carries a socket holder 60 at the top thereof. FIGS. 16–18 show further details of portions of the jig shown totally in FIG. 15.

The platform 54 is provided with a series of holes, each of which accommodate one of the rods 58. The bottom of each rod 58 is provided with a pin 62 which limits the upward position of the rod 58. This pin 62 rides within a slot 64 in cylindrical guide 66. The guides 66 may each be fixed in position resting in a base 68. The guides 66 are fixed so that they are not rotatable and thus the rod 58 is also not rotatable but is permitted vertical movement with the pin 62 riding in the slot 64. A second pin 70 also extends through rod 58 and a spring 72 extends between the pin 70 and the top surface of platform 54. The spring 72 normally biases the rod 58 to its uppermost position.

The lamp holder 60 is affixed to the top of the rod 58 by means of a set screw 75 which is shown in FIG. 17. The holder 60 comprises a solid base 76 and four upstanding posts 78 arranged in a pattern as shown in FIG. 18. FIG. 18 is a plan view of the holder shown in FIG. 16 and between pairs of the legs 78 there are provided vertical slots 80 which are for accommodating the wires 18 shown in FIG. 16. In addition, there is also a space 82 provided and if the adapter shown in FIGS. 2–4 is employed, this space 82 accommodates the legs of the adapter. The holder 60 may also be of a different shape if, for example, other of the adapters are used. The holder specifically shown in FIGS. 15–18 is primarily designed for accommodating the adapter shown in FIGS. 2–4.

The jig is used in the following fashion: The springs 72 bias all of the rods 58 to their upward position. The rods 58 are of different lengths corresponding to the candelabra which is shown in dotted in FIG. 15. Before the candelabra is inserted over the holders 60 the string of lamps is strung with each lamp socket 20 (see FIG. 16) sitting within the holder 60 with its associated wires 18 extending downwardly through slots 80. After all of the sockets 20 have been inserted in place in their corresponding holders, then the candelabra is inserted over the jig and rests in the position shown in dotted in FIG. 15. In this position, the holders 60 and their sockets should be extending upwardly above the top ends of each of the candle tubes. The adapters are then each fitted over the socket with the long leg extending into the space 82. The adapter is then pushed downwardly sufficient to have the leg engage under the bottom of the socket. When each of the adapters has been inserted intermediate the socket and the candle tube then the assembled candelabra can be lifted from the jig with all of the lamp assemblies being maintained in the proper position.

Alternatively, the method of the present invention can be performed without the use of the jig wherein each lamp of the string is individually inserted up through the candle tube. The adapter is then similarly fitted to the socket and pushed downwardly to lock the socket in place and firmly seat the adapter to the top of the candle tube.

Having described the limited number of the forms of the apparatus and method of this invention, it should now become apparent that numerous modifications are contemplated as falling within the scope of the present invention.

What is claimed is:

1. A lamp apparatus comprising;

at least one hollow candle tube, means including a base for supporting the candle tube at its bottom end to permit the tube to stand substantially vertically, a lamp assembly including a low wattage lamp, a cylindrical body defining a receiving socket for the lamp and conductor means carried by the receiving socket and coupled to the lamp, and an adapter having an annular body defining an opening and adapted to be disposed within the candle tube at the top end of the candle tube and at least one downwardly depending resilient leg having means at its free end for limiting the position of the cylindrical body relative to the adapter, said cylindrical body having a diameter comparable to the diameter of the opening in the adapter to provide a snug fit when the cylindrical body is in the adapter, said adapter being inserted downwardly over the cylindrical body with the resilient leg deflecting until the limiting means engages the bottom of the cylindrical body.

2. A lamp apparatus as set forth in claim 1 wherein said annular body terminates in a circular edge defining a lip having a diameter greater than the inner diameter of the candle tube to thereby limit the position of the adapter relative to the tube.

3. A lamp apparatus as set forth in claim 1 wherein said limiting means includes a flange engaging the bottom of the cylindrical body.

4. A lamp apparatus as set forth in claim 1 having only one downwardly depending resilient leg that has limiting means associated therewith.

5. A lamp apparatus as set forth in claim 1 including at least one other leg spaced from the downwardly depending leg but being shorter in length thereof.

6. A lamp apparatus as set forth in claim 5 including two shorter legs with the three total legs spaced equally about the body and all legs being integrally formed with the annular body.

7. A lamp apparatus as set forth in claim 1 wherein the adapter includes a top lip that engages the top end of the candle tube to limit the position of the adapter relative to the tube keeping the adapter from being positioned totally within the candle tube.

8. A method of wiring a candelabra having a plurality of individual candle tubes and including a plurality of low wattage lamp assemblies each including a lamp socket and lamp and conductor means interconnecting each lamp assembly, said method comprising;

inserting a single lamp assembly with its associated conductor means up through a candle tube until the lamp assembly including the socket extends above the top of the candle tube, providing an adapter dimensioned to fit within the top of the tube, having a passage for receiving the socket, and at least one downwardly depending resilient leg having a flange at its free end for limiting the position of the socket relative to the adapter, positioning the adapter over the socket, pushing the adapter down over the socket causing the leg to deflect slightly until the flange engages the bottom of the socket, pushing the lamp assembly and adapter down into the tube a predetermined short distance with the lamp extending above the candle tube, and repeating the above steps for other lamp assemblies and corresponding tubes.

* * * * *